US008121304B2

(12) United States Patent
Bales et al.

(10) Patent No.: US 8,121,304 B2
(45) Date of Patent: Feb. 21, 2012

(54) ANTI-TANGLE DEVICE AND METHOD FOR PREVENTING CORD TANGLING

(76) Inventors: Gregory Oren Bales, Coral Gables, FL (US); William Thomas Bales, Coral Gables, FL (US); Maxwell Ryan Bales, Coral Gables, FL (US); Thomas O. Bales, Jr., Coral Gables, FL (US)

( * ) Notice: Subject to any disclaimer, the term of this patent is extended or adjusted under 35 U.S.C. 154(b) by 494 days.

(21) Appl. No.: 12/334,862

(22) Filed: Dec. 15, 2008

(65) Prior Publication Data

US 2010/0150370 A1 Jun. 17, 2010

(51) Int. Cl.
*H04R 1/10* (2006.01)

(52) U.S. Cl. ..... 381/74; 381/374; 381/384

(58) Field of Classification Search ..... 381/74, 381/370, 374, 384; 174/72 A
See application file for complete search history.

(56) References Cited

U.S. PATENT DOCUMENTS

| | | | | |
|---|---|---|---|---|
| 7,436,974 | B2 * | 10/2008 | Harper | 381/374 |
| 7,514,630 | B2 * | 4/2009 | Anderson | 174/72 A |
| 2008/0101633 | A1 * | 5/2008 | Ledbetter et al. | 381/309 |

FOREIGN PATENT DOCUMENTS

| | | | |
|---|---|---|---|
| KR | 2019950034643 | * | 12/1995 |
| KR | 2019970011662 | * | 3/1997 |

* cited by examiner

*Primary Examiner* — Kevin M Picardat
(74) *Attorney, Agent, or Firm* — Mayback & Hoffman; Gregory L. Mayback; Rebecca A. Tie

(57) ABSTRACT

An anti-tangling device includes a headphone cord having a distal end, a male signal plug at the distal end, a proximal end, and at least one earphone at the proximal end. Each of the plug and the earphone has first or second parts of a two-part connection device. The two-part connection device removably secures the plug and the earphone to one another. In an embodiment, the plug is the first part and the earphone has a plug-in portion as the second part. The plug-in portion defines a female port shaped to removably secure the plug therein and, when secured, forms a continuous loop with the cord, the plug, and the earphone. The plug-in portion can be integral with or removably attached to the earphone. The first and second parts can be a magnet and a magnetized piece, a hook-and-loop type fastener, or parts of a press-fit snap fastener.

14 Claims, 12 Drawing Sheets

ANTI-TANGLE DEVICE AND METHOD FOR PREVENTING CORD TANGLING

STATEMENT REGARDING FEDERALLY SPONSORED RESEARCH OR DEVELOPMENT n/a

FIELD OF THE INVENTION

The invention lies in the field of cords and anti-tangle technology.

BACKGROUND OF THE INVENTION

A cord is a long, slender, and flexible material that can take the form of many shapes and sizes, and be made of a large number of different materials. As used herein, cord encompasses wire, string, cable and a multitude of other variations and materials. Some cords have one beginning and one end. One example of such a cord is an electric appliance cord that can be removed from the appliance. One end has a plug for insertion into an electric mains and the other end is inserted into a jack (either female or male) on the appliance.

Other applications involve cords with more than one beginning and one end. Various telephone cords, for example, split after a certain length to connect two or more telephones to a telephone jack in the wall. Similarly, a number of television cords, whether using cable or satellite, split at certain points in order to transfer data to multiple television sets or to send signals to different channels, such as the L and R speaker channels. Another example is a cord used for electronic headphones. Such headphone cords extend from an electronic device to a listener's ears, allowing the listener to hear audio. These cords have been in existence for decades. Such electronic devices serve a myriad of purposes; examples include, but are not limited to, cassette players, Compact Disc/DVD players, and MP3 players. Some users choose to listen to music while exercising, while others listen to an electronic device throughout the day no matter what the task. Although commonly used for music, any audible sound can be played through the earphone cords. For instance, some students listen to lectures and other audible study aids utilizing these electronic devices.

In use, a listener inserts a male plug end of the headphone cord (e.g., a 3.5 mm male plug) into a corresponding female socket of the electronic device. After a certain length, the headphone cord splits into two separate cords, resulting in a "Y" configuration. These two ends are fitted with earphones that fit into or around a person's left and right ears. One example is the common earbud configuration. On some models, the earphone orientation is ear specific, whereas, in other models, the earphones are interchangeable between the user's left and right ears.

One of the drawbacks regarding existing headphone technology is the likelihood of the cords becoming intertwined. Mathematical studies of tangling reveal that cords become tangled because loose ends are allowed to snake into loops of the cord or because loops are allowed to snake into other loops. When an end travels through a loop as the cord twists and turns, knots are created. In the embodiment of headphones, when a user is not wearing the device, cord ends are unrestrained and free to move in any direction. While the headphones are stored, for instance, lying on a desk, in a drawer, or in a bag, to name a few, the free ends inevitably become intertwined and tangle. Once tangling occurs, a person is required to spend needless time and effort attempting to untangle the various ends. Moreover, once a person successfully untangles the headphone cords, there is nothing to prevent the cord ends from tangling yet again in the future. In addition, the tangling can result in knots, thereby creating kinks in the wires inside the cords and potentially damaging the operation of the headphones.

Placing a spool or similar retraction device in the middle of the wire does not solve the fundamental problem. A spool winds the cord around a cylinder. However, the ends of the headphones still remain unrestrained and free to intertwine. In addition, the winding of a headphone cord around a spool causes the cord to conform to the circular shape of the cylinder. Thus, when later unwound, a multitude of loops is created for the ends to travel through, representing a fertile breeding ground for tangling.

With the dramatic rise of electronic media packaged for consumers on the go, countless consumers are purchasing handheld electronic devices that require the use of headphones. It would, therefore, be desirable to provide a way of limiting the travel of the ends of headphone cords to prevent the occurrence of tangling and knots.

SUMMARY OF THE INVENTION

The present invention provides an anti-tangling device that overcomes the hereinafore-mentioned disadvantages of the heretofore-known devices of this general type and limits the travel of cord ends. The anti-tangling device of the present invention prevents tangling of cords by connecting their various ends. With the ends of the cord thus restrained, tangling can no longer occur. As set forth above, mathematical tangling studies reveal that cords tangle because one end snakes into and through a loop (or one loop snakes into and through another loop). By eliminating the possibility of a cord end or loop snaking through another loop, cord ends are prevented from tangling.

According, to one embodiment of the present invention, the anti-tangling device connects the ends of headphone cords to create a continuous path with the headphone cord. As a result, the ends are restrained by the continuous path eliminating any opportunity for the headphone ends to snake through one or more loops.

Although the invention is illustrated and described herein as embodied in an anti-tangling device and method for preventing cord tangling, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

BRIEF DESCRIPTION OF THE DRAWINGS

Advantages of embodiments of the present invention will be apparent from the following detailed description of the preferred embodiments thereof, which description should be considered in conjunction with the accompanying drawings in which.

DETAILED DESCRIPTION OF THE INVENTION

Figure 1:
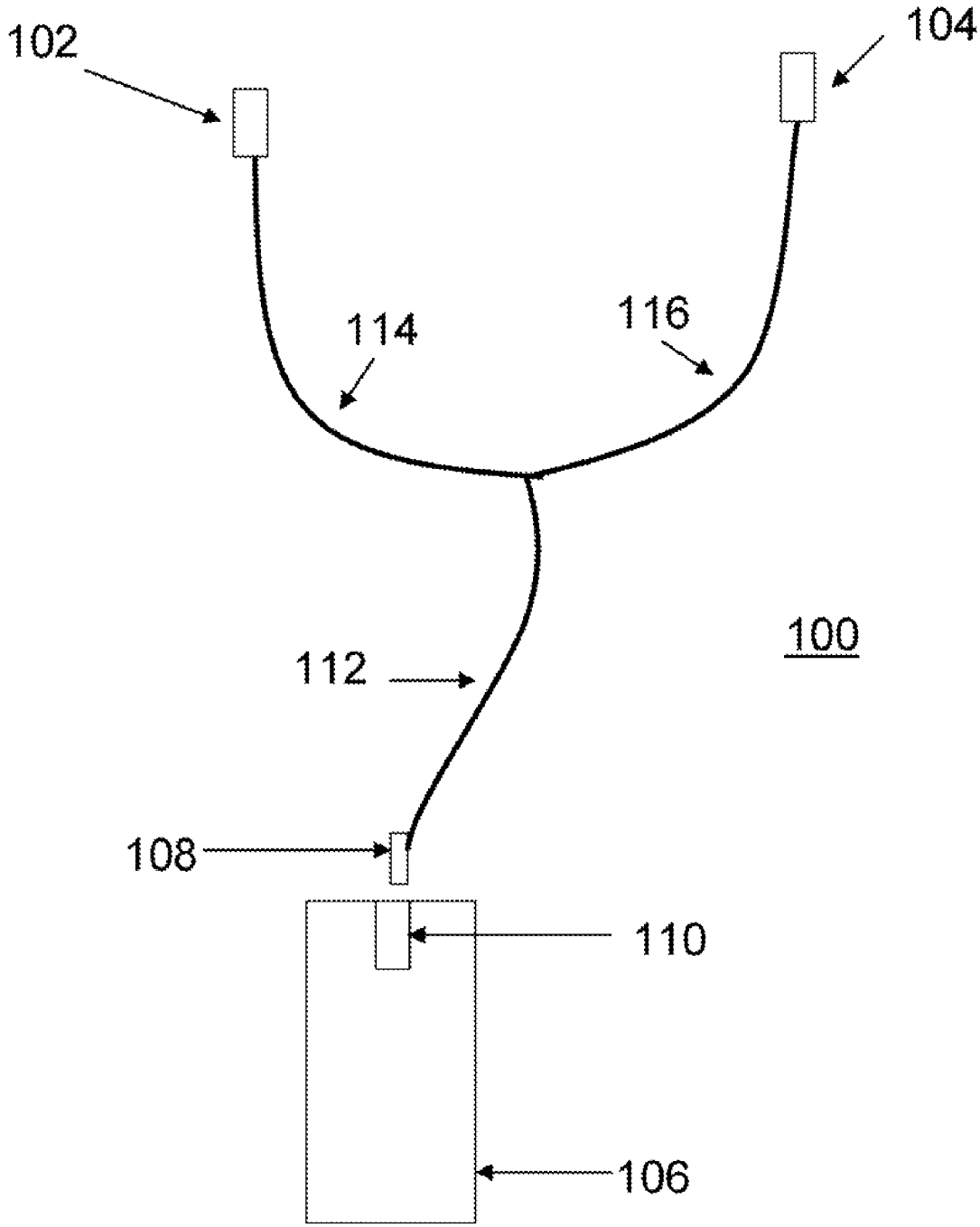
FIG. 1 is an elevational view of a prior art Y-configuration headphone cord with two earphones and a male plug, along with a diagrammatic illustration of an electronic device for use with the cord.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. It must be noted that, as used in the specification and the appended claims, the singular forms "a," "an," and "the" include plural references unless the context clearly dictates otherwise.

While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Devices for transferring data from an electronic source to a person's ears (such as MP3 players) are commercially available. One example of cords that can easily become tangled are headphone cords that connect to electronic devices through the male plug end. After a certain length, the cord splits into a "Y" configuration and the earphones at the opposing end of the headphone cord convert the data from the electronic device into sound. As a result, a person can listen to the data generated from the electronic device through the headphones.

The term "earphone" as used herein encompasses any type of device that projects sound into a listener's ear(s). For example, this may include earbuds that fit directly into the ear canal, devices that wrap around the listener's ear lobes and minimally infiltrate the ear canal, and devices that merely cover the ear.

Referring now to the figures of the drawings in detail and first, particularly to FIG. 1 thereof, there is shown an exemplary illustration of headphones 100 containing two earphones 102, 104 connected to an electronic device storing data 106. The male headphone plug 108 is secured removably to the electronic device storing data 106 at the female socket or jack 110 to permit data transfer between the two. The female socket 110 is a standard recessed cavity in an electronic device that secures the male headphone plug 108 when inserted therein. The headphone 100 has a first portion 112 connected to the male plug 108 and second and third portions 114, 116 respectively connected to each of the earphones 102, 104.

Figure 2:
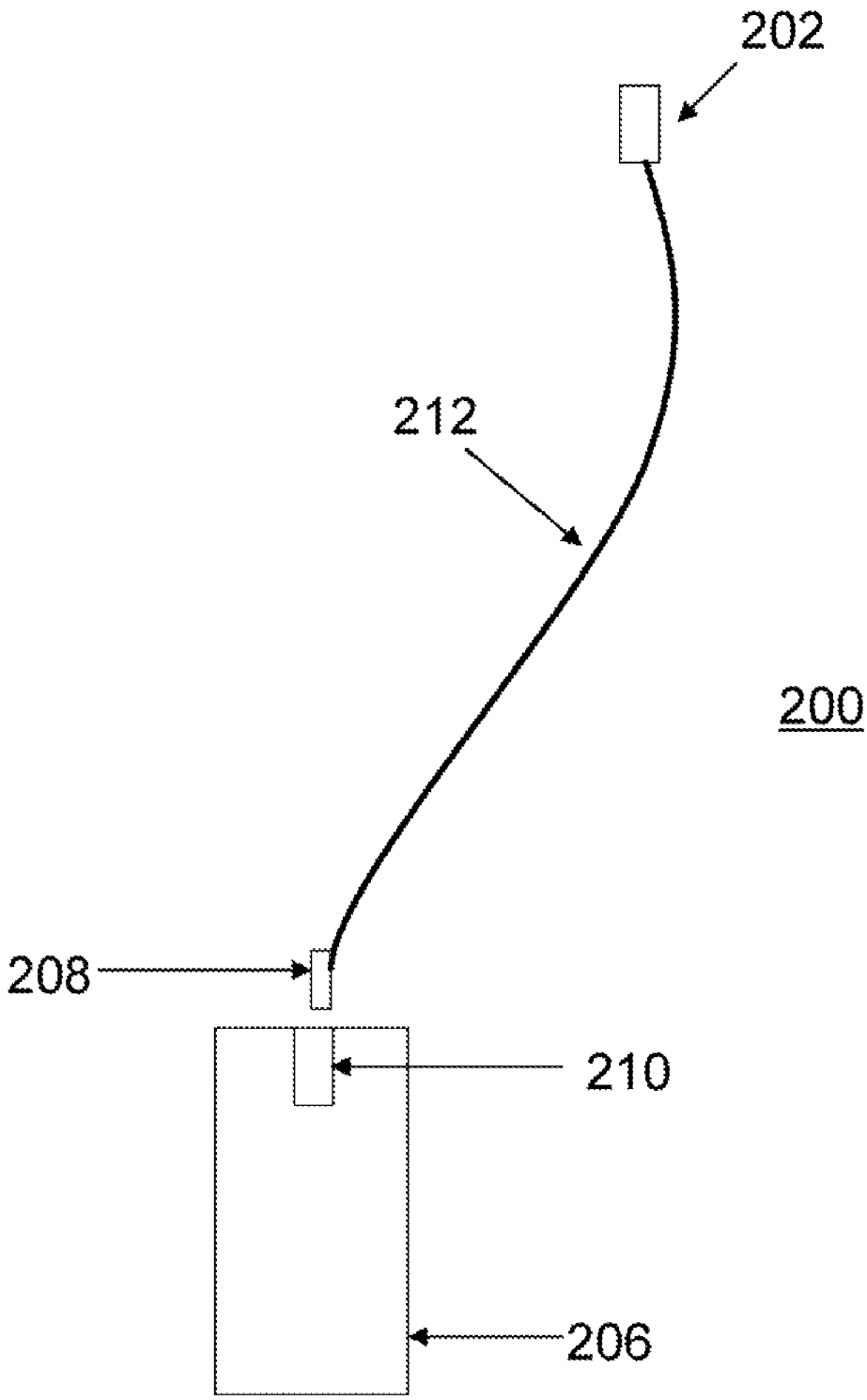
FIG. 2 is an elevational view of a prior art headphone cord with one earphone and a male plug, along with a diagrammatic illustration of an electronic device for use with the cord.
Figure 3:
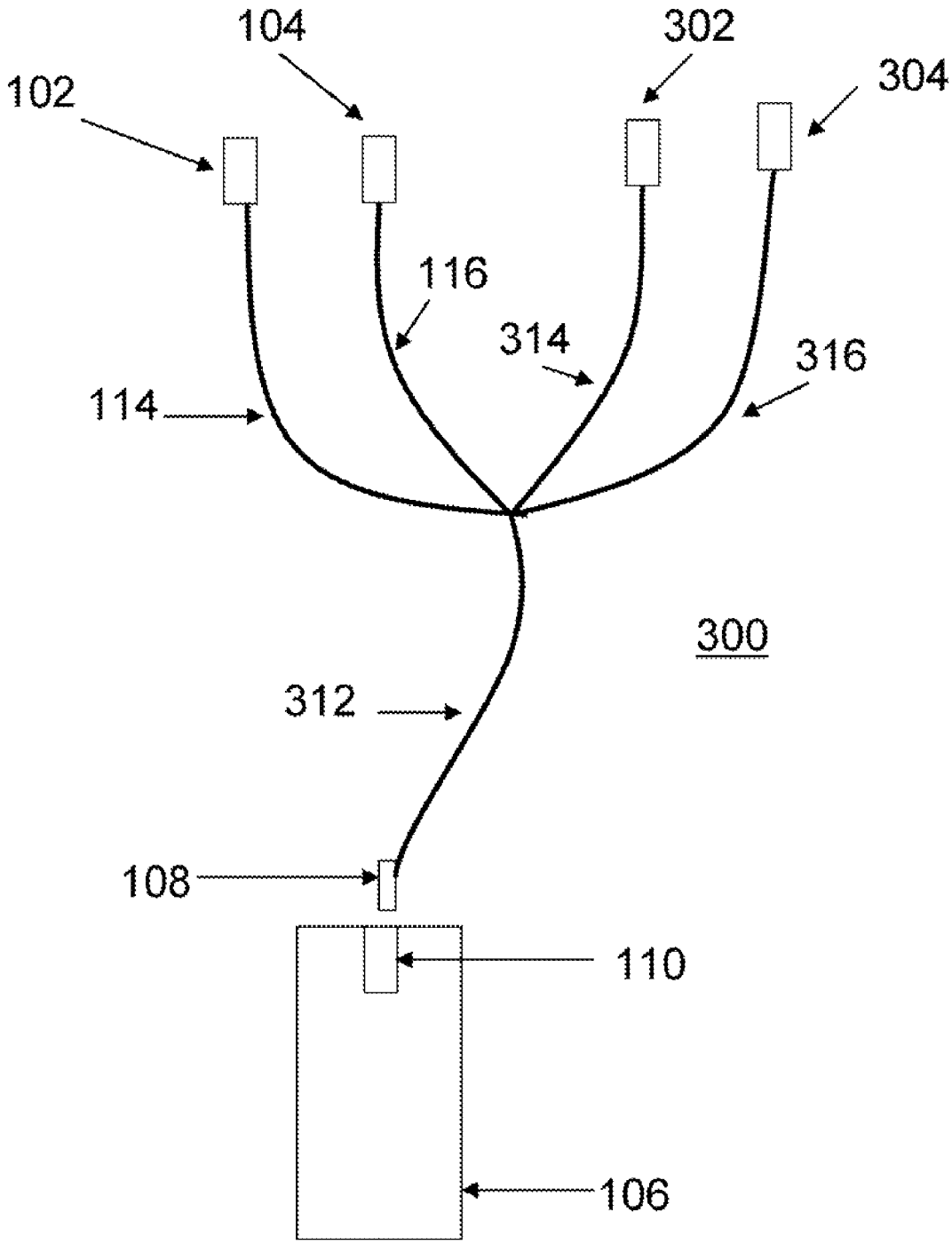
FIG. 3 is an elevational view of a prior art headphone cord with four earphones and one male plug, along with a diagrammatic illustration of an electronic device for use with the cord.

Although most headphone cords are configured in a standard "Y" configuration shown in FIG. 1, the present invention encompasses all cords. FIG. 2, for example, depicts a single headphone 200. This headphone 200 has one cord 212 and two ends, one of the ends having an earphone 202 and the other end having a male plug 208 removably secured within a female socket 210 in the electronic device 206. Alternatively, FIG. 3 shows a headphone cord 300 that supports two users listening with both ears. Earphones 102, 104, 302, 304 are connected to a main cord 312 through four connection cords 114, 116, 314, 316. As FIGS. 2 and 3 illustrate, the present invention covers cords with at least one end to cords with a large number of ends.

Figure 4:
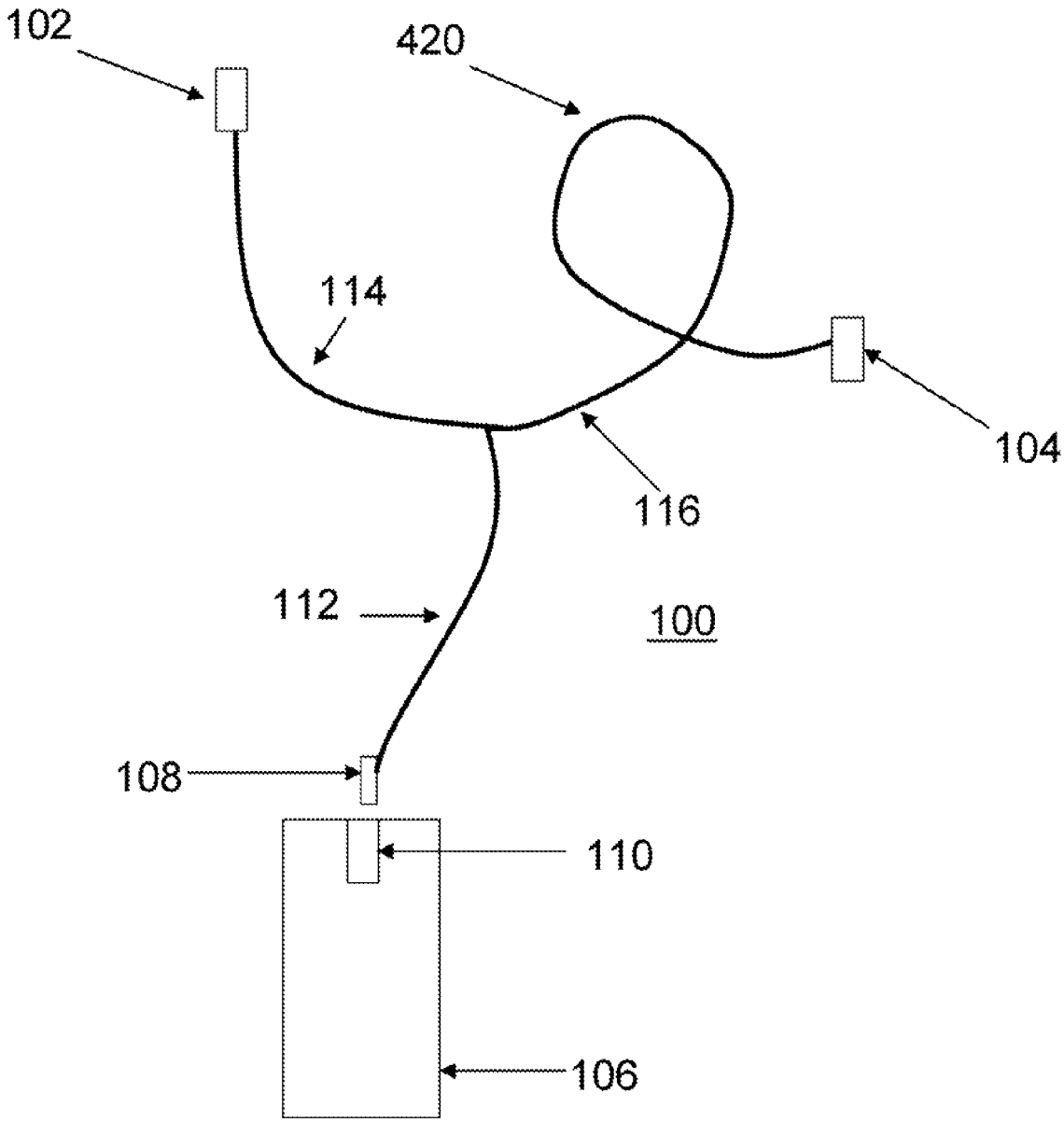
FIG. 4 is an elevational view of the Y-configuration headphone cord of FIG. 1 with one of the earphone cords forming a loop.
Figure 5:
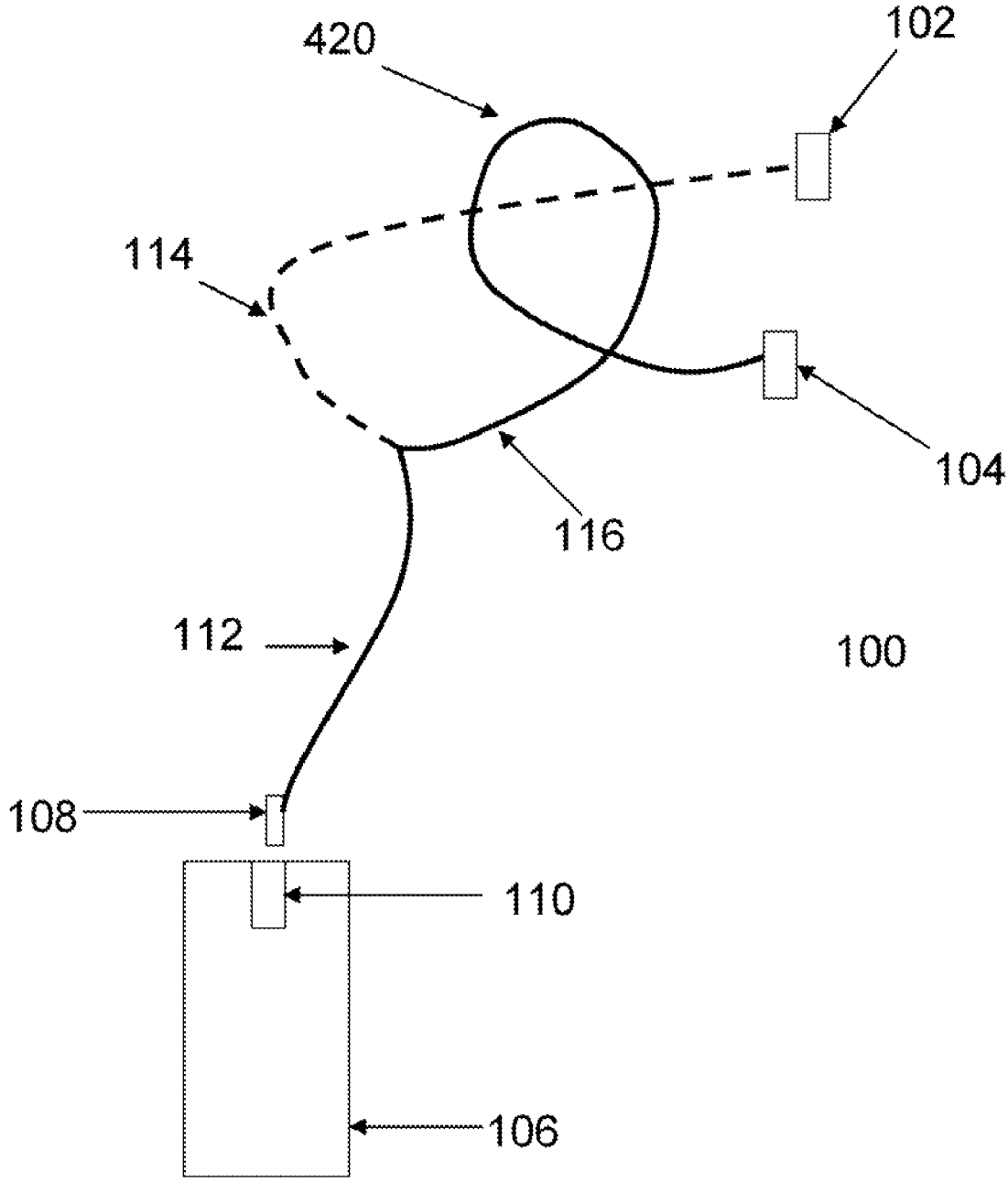
FIG. 5 is an elevational view of the Y-configuration headphone cord of FIG. 4 with one earphone cord traveling through the loop of the other earphone cord.

FIG. 4 illustrates a headphone cord 100 with one portion 116 forming a single loop 420. This loop 420 facilitates headphone cord tangling because either of the earphones 102 or 104 or the male plug 108 can travel through the loop 420. FIG. 5, for example, shows (through the dashed line) the earphone 102 traveling through the loop 402. Tangling will result from interaction between one of the earphones 102, 104 and/or the male plug 108 with the loop 402. Although the loop 402 is displayed at a location on portion 116, the present invention acts to prevent tangling when the loop(s) 402 occur (s) anywhere on the headphone cord 112, 114, 116, 312, 314, 316.

Figure 6:
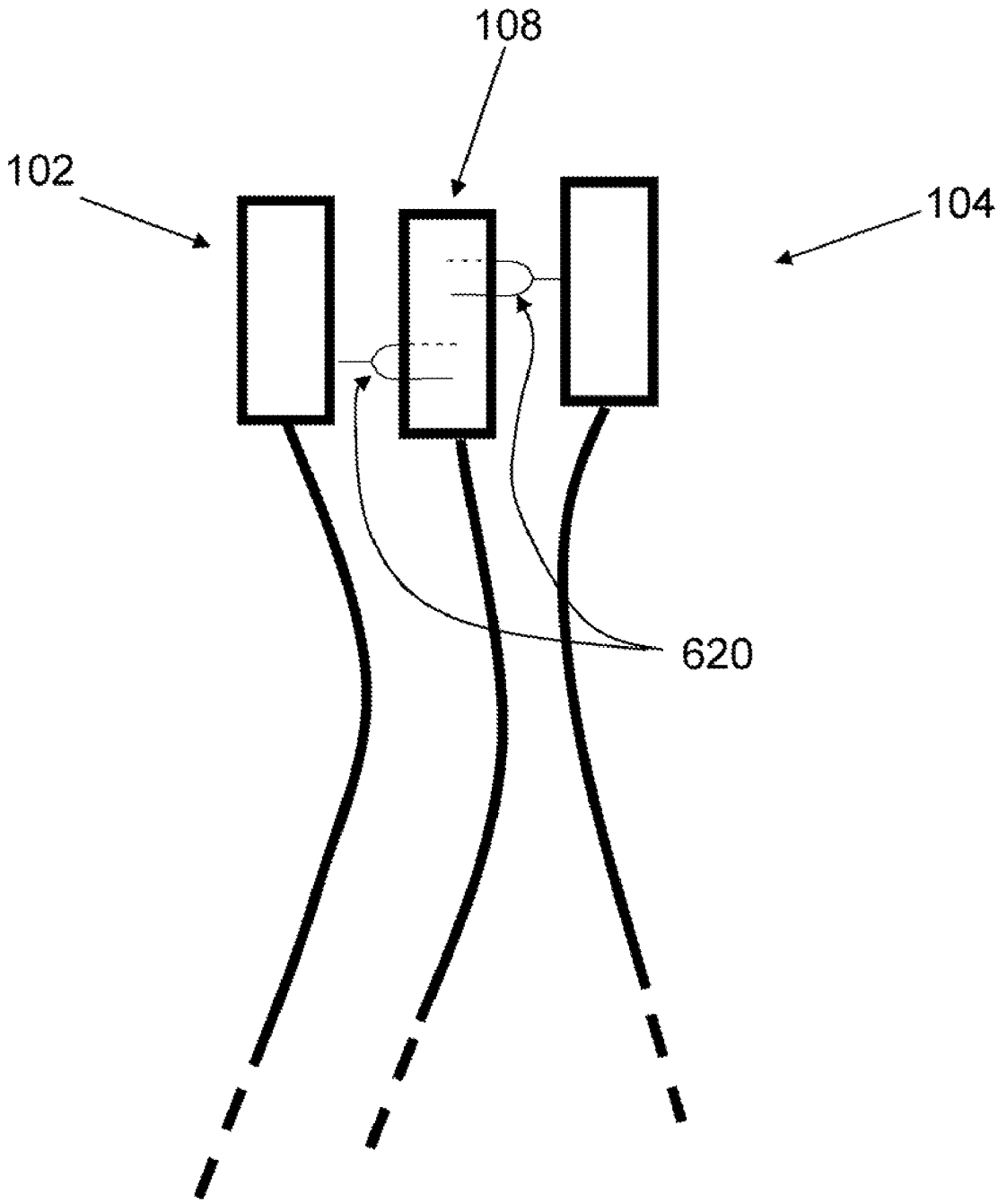
FIG. 6 is an elevational view of a snap ring connection according to an exemplary embodiment of the invention holding two headphone earphone cords and male plug cord in place.

The present invention, an anti-tangling device applicable to a multitude of cord types, prevents tangling by connecting the various free ends of any cord together. For example, FIG. 6 illustrates a first exemplary connection device and method for the two earphones 102, 104 and the male plug 108. In this embodiment, the two earphones 102, 104 are connected to the male plug 108 utilizing snap rings 620 that are present on each earphone 102, 104 and loop around the male plug 108 in a snap fit. These snap rings 620 can take any form or shape as long as there is a structure that can be opened to allow the parts 102, 104, 108 to be removably secured therein. For example, the clasp can be two plates that are biased towards one another and, when separated, can accept the parts 102, 104, 108 therein. When released, the plates move towards one another and clamp the parts 102, 104, 108 therebetween. By connecting the earphones 102, 104 and male plug end 108 together, no individual cord end can travel through a loop 402. By using the anti-tangle device 620, free ends no longer exist.

Thus, even if loops are created in any intermediate cord portion when the cord is jumbled, crumpled, stored, or otherwise tangled, the continuous loop of the cord will be preserved as tangling does not occur in the absence of free ends.

Figure 7:
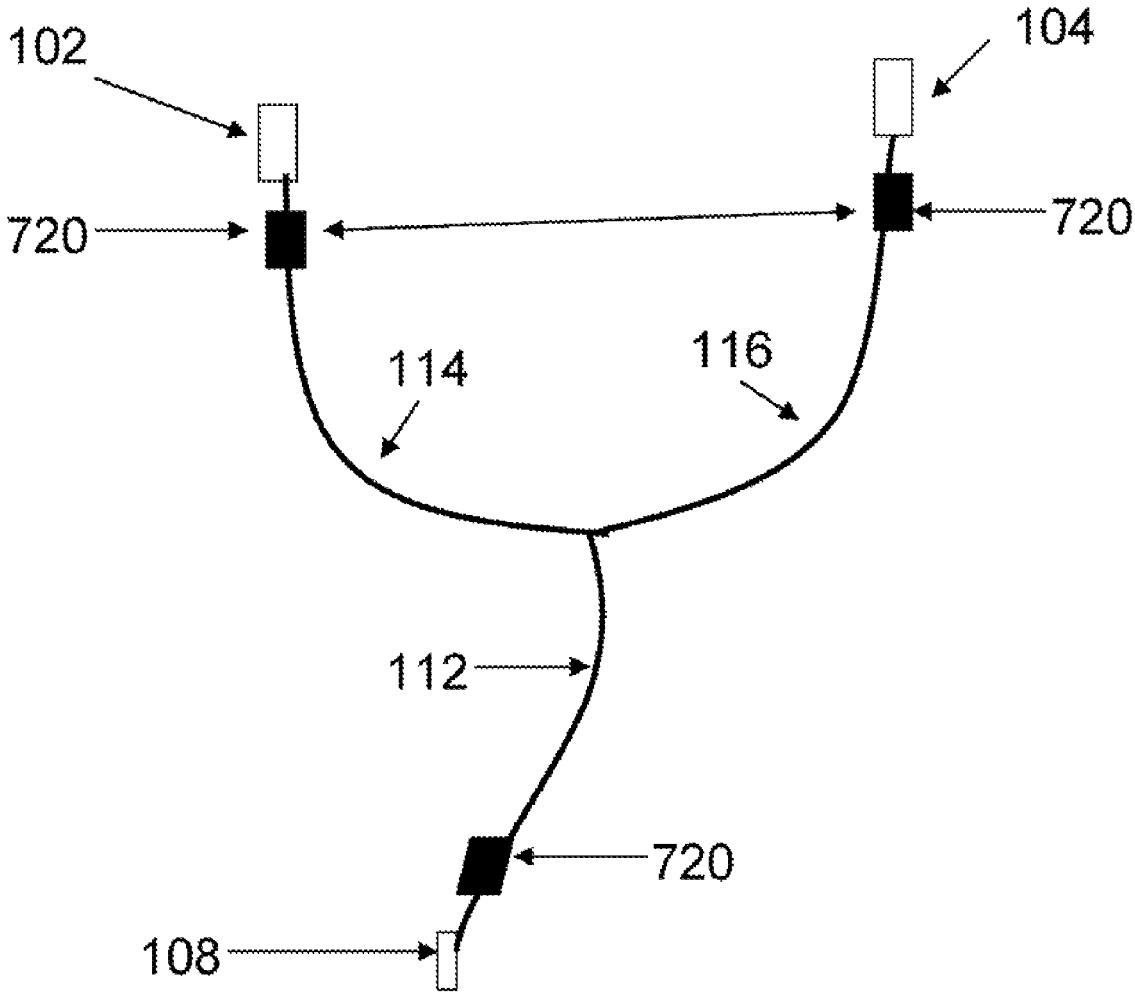
FIG. 7 is an elevational view of a Y-configuration headphone cord according to an exemplary embodiment of the invention with magnets at each end that serve to connect all the ends together.
Figure 8:
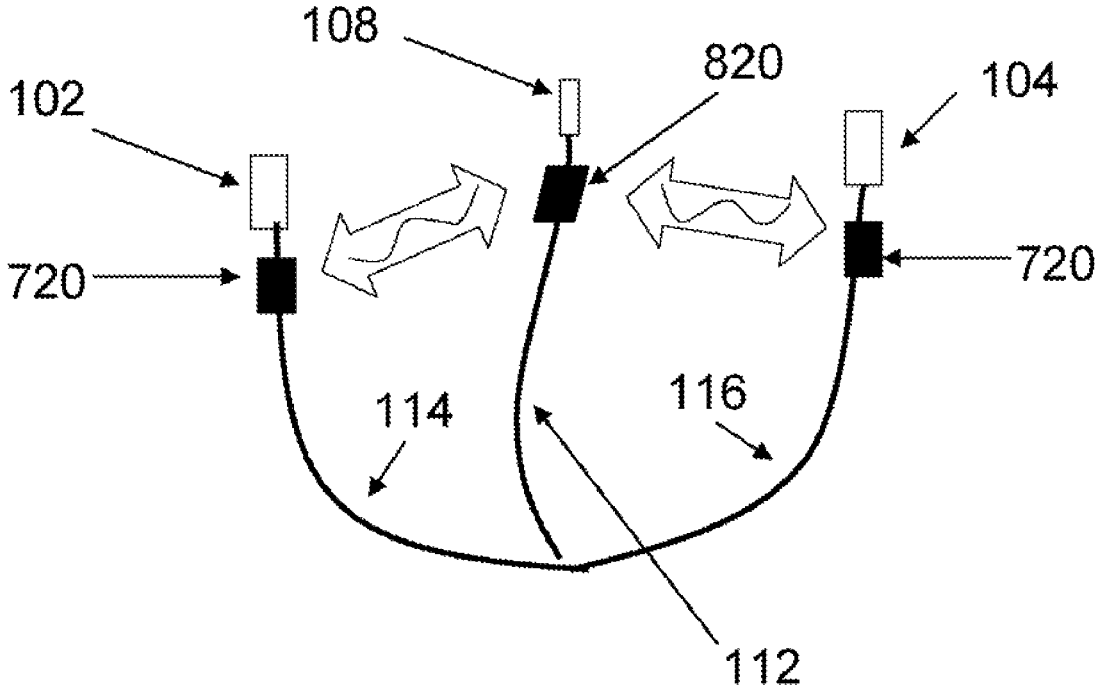
FIG. 8 is an elevational view of a Y-configuration headphone cord according to an exemplary embodiment of the invention with magnets at each earphone end each magnetically attracted to a piece of steel at the male plug end.

Another embodiment, shown in FIG. 7, utilizes magnets 720 to connect the cord ends. These magnets 720 are configured to not interfere with functioning of an electronic device 106 or transmission of sound from the earphones 102, 104. An alternative to using magnets at all three ends is to use magnets 720 at the two earphones 102, 104 and a piece of magnetic metal 820, such as steel, at the male plug 108, which is shown in FIG. 8. The electromagnetic attraction between the magnets 720 and the steel 820 results in the removable connection of all three ends 102, 104, 108. Alternatively, each earphone 102, 104 can hold the steel 820 and the male plug 108 can hold the magnet 720.

Figure 9:
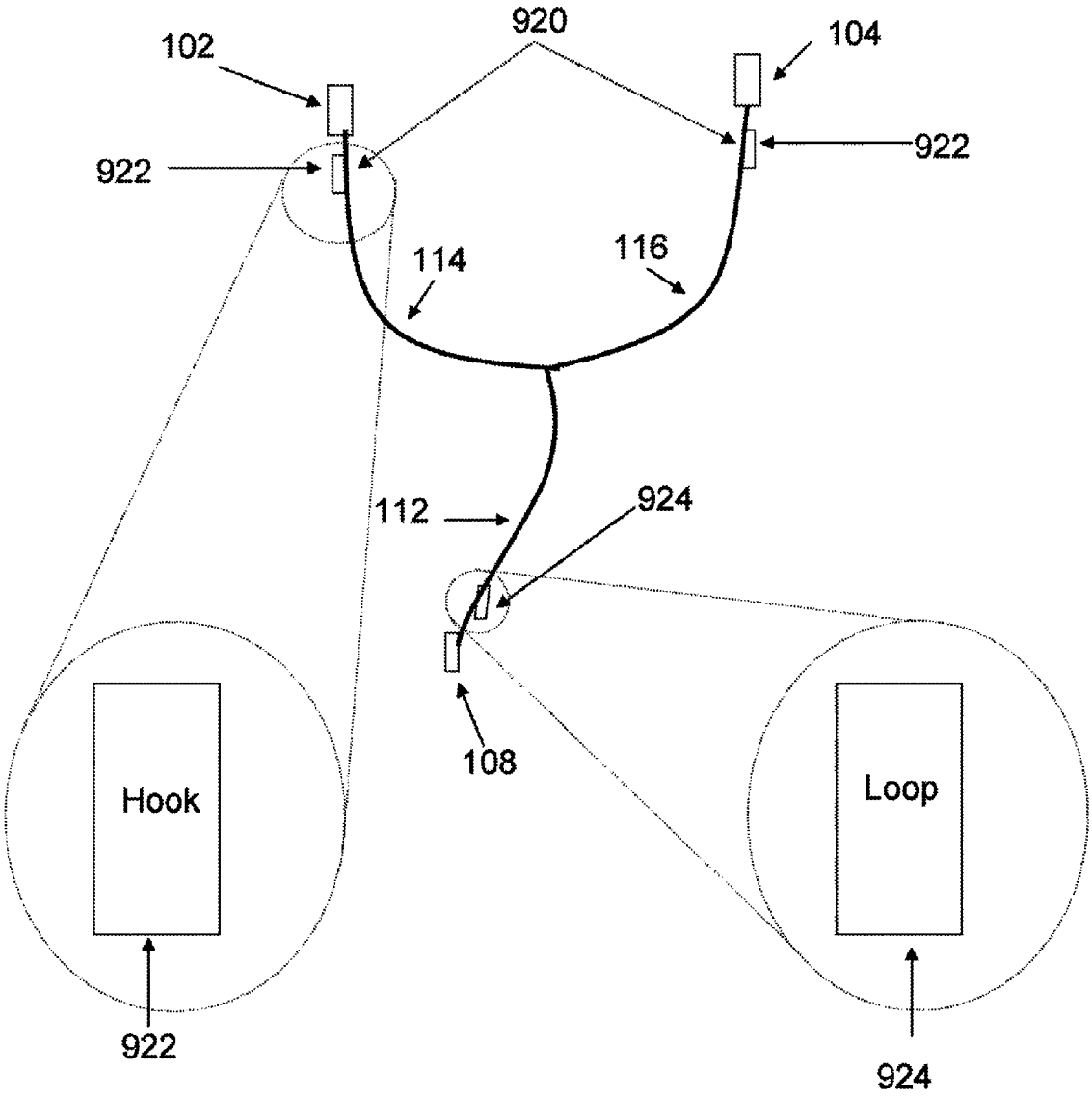
FIG. 9 is an elevational view of a Y-configuration headphone cord according to an exemplary embodiment of the invention where a hook-and-loop type fastener, such as VELCRO®, is used to connect the ends together.

FIG. 9 illustrates another exemplary connection of the earphones 102, 104 and male plug end 108 using a hook-and-loop type fastener 920, such as VELCRO®. A hook-and-loop type fastener 920 has a hook side with small hooks 922 and loop side with even smaller loops 924. The joining of the hook side 922 with the loop side 924 makes a secure but removable connection. When the user is not using the headphones, the two earphones 102, 104 and the male plug 108 are pressed together and held using this fastener 920.

Figure 10:
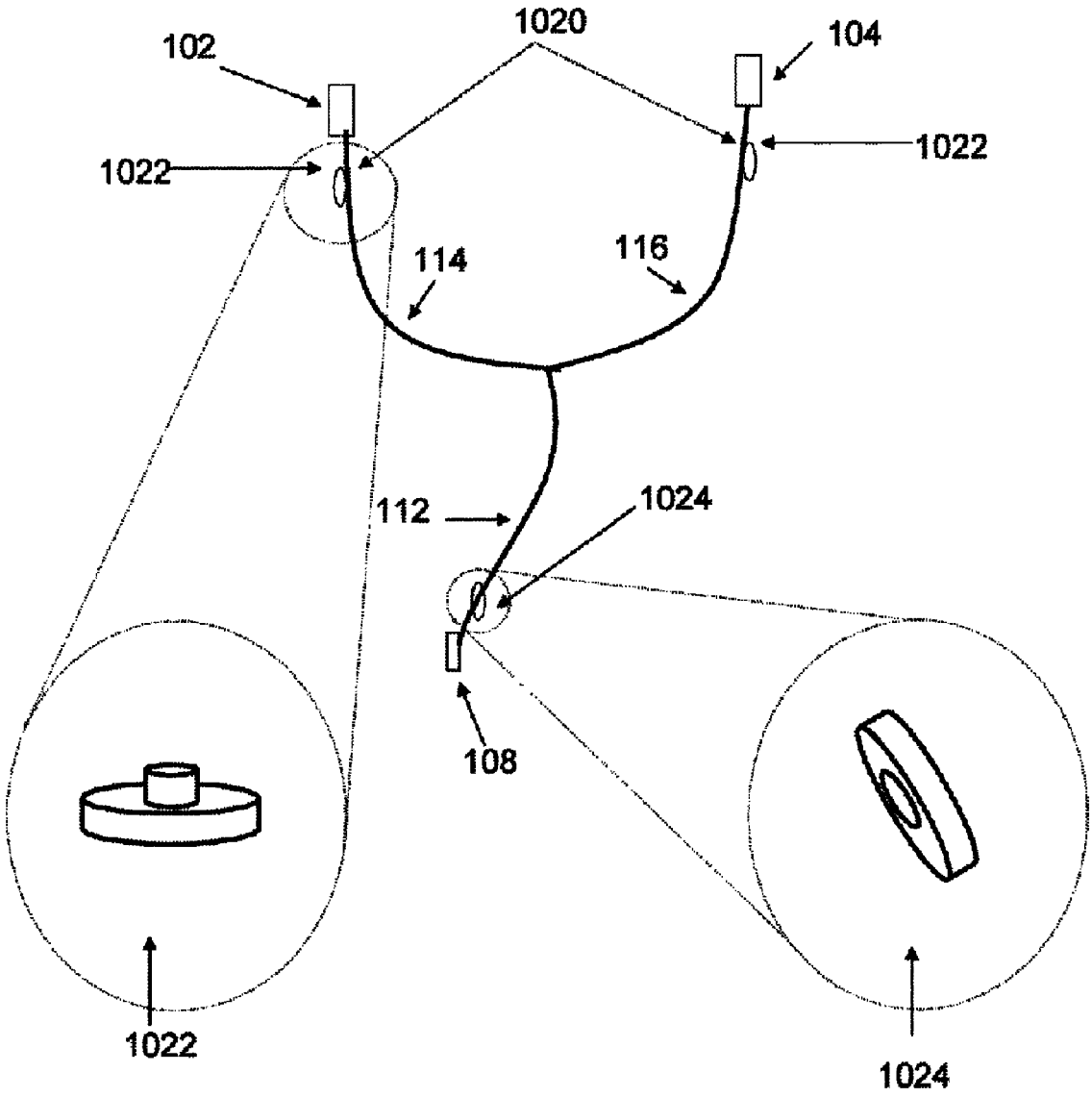
FIG. 10 is an elevational view of a Y-configuration headphone cord according to an exemplary embodiment of the invention with male/female snap connections at the cord ends.

In addition, any type of snap 1020 can be used to connect the earphones 102, 104, shown in FIG. 10, together. For example, one embodiment uses a well-known snap 1020 with a male/female coupling connection to secure the earphones 102, 104 together. The male portion 1022 of the coupling 1020 has a protruding part above its planar surface that inserts into the recessed cavity below the planar surface of the female portion 1024. To have such a male/female coupling connection, there is at least one male and one female coupling element.

Figure 11:
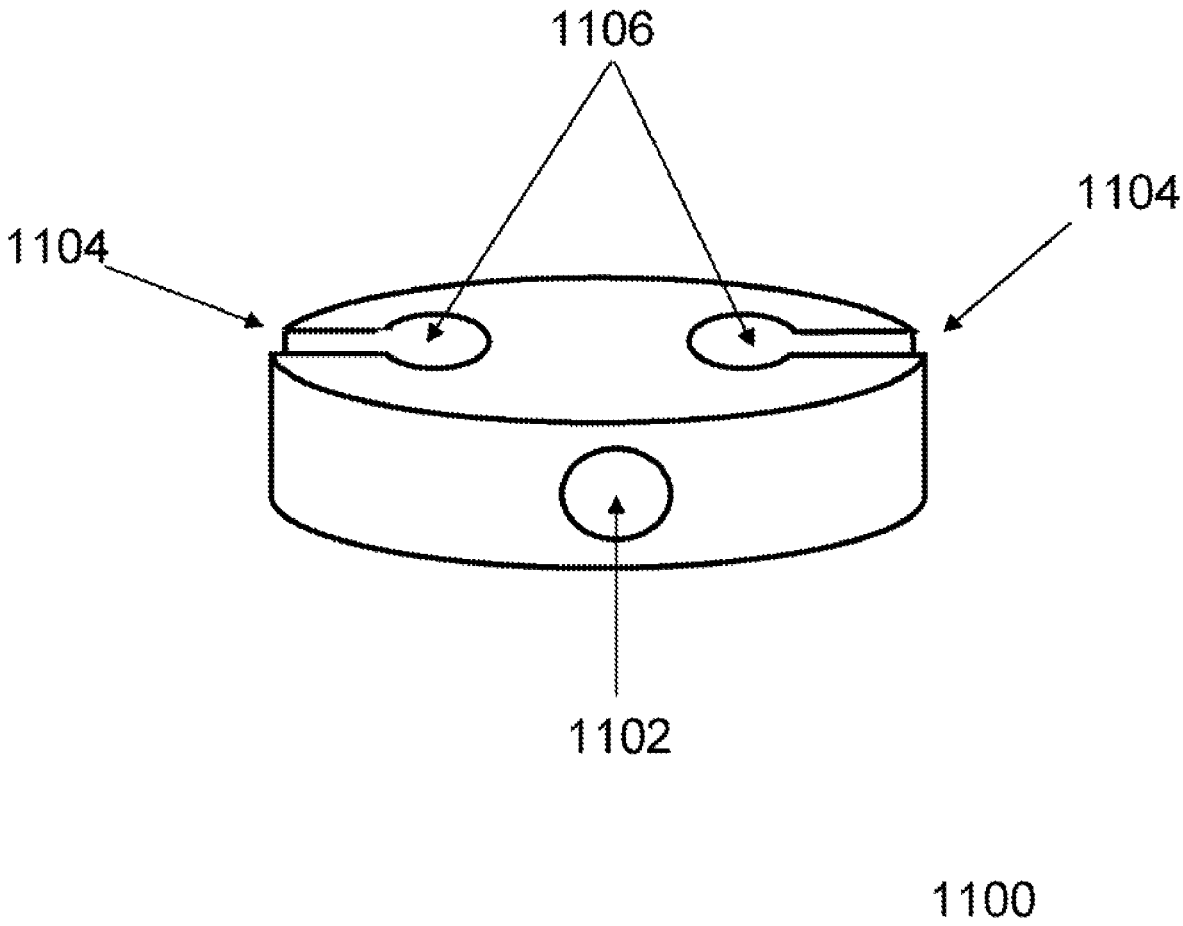
FIG. 11 is perspective view of a three dimensional device according to an exemplary embodiment of the invention in which the headphone male plug is inserted into a female socket of the device and the earphone cords are removably secured within inlets of the device.

As shown in FIG. 11, another embodiment of the present invention is a device separate from the cord. This embodiment has at least one female socket 1102 and is similar to the female socket 110 in the electronic device 106. This female socket 1102 allows the male plug 108 to be inserted and removably secured therein. Where the cord embodiment has two ends opposite the male plug 108 (such as in a Y-configuration of the headphone 100), the device has two inlets 1104, each with a press fit connection to secure a respective one of the two earphones 102, 104 therein. The inlets 1104 are sized for a close-fit with the respective headphone 102, 104 or with the headphone cords 112, 114, 116. An additional exemplary embodiment encompasses enclosures 1106 that widen from the inlets 1104 but do not meet.

Figure 12:
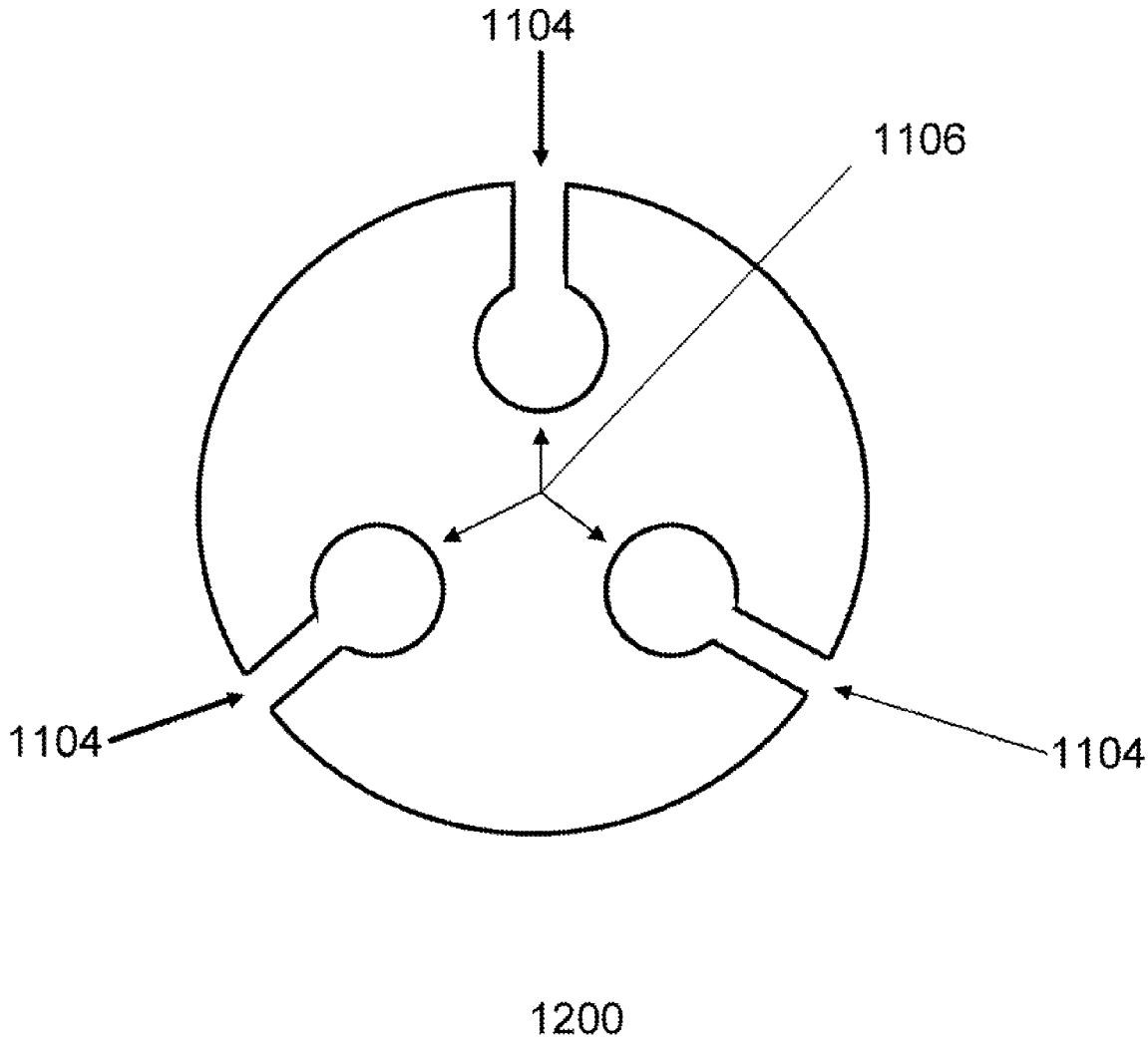
FIG. 12 is a plan view of a three dimensional device according to an exemplary embodiment of the invention having inlets in which the headphone earphone cords and male plug are inserted and removably secured.

In yet another exemplary embodiment, FIG. 12 shows a storage device 1200 having a geometric shape where at least one of the earphones 102, 104, the male plug 108, and the headphone ends 102, 104 or cords 112, 114, 116 are inserted and stored. Although shown with a circular outer shape, the storage device 1200 can take any form. There are at least two inlets 1104 through which the headphones or cords travel. The inlets 1104 are sized for a close-fit with the respective earphones 102, 104, the male plug 108, and the headphone cords 112, 114, 116 so the parts can travel therethrough for reliable anti-tangling storage. In addition, another exemplary embodiment encompasses enclosures 1106 widening from the aforementioned inlets 1104. In both embodiments, the inlets and enclosures travel inward from the exterior of the storage device 1200 but do not meet. Once the headphone cords 112, 114, 116 are inserted into the storage device 1200, the free ends are restrained and cannot travel through a loop and become tangled.

We claim:

1. An anti-tangling device, comprising:

a headphone cord having:

a distal end;

a male signal plug at said distal end;

a proximal end; and at least one earphone at said proximal end, said earphone having a plug-in portion removably attached therein and defining a female port shaped to removably secure said plug therein and, when secured, a continuous loop is formed by said cord, said plug, and said earphone.

2. The anti-tangling device according to claim 1, further comprising:

a magnet emitting a magnetic field and a magnetized piece attracted by said field;

each of said magnet and said magnetized piece is secured to a respective one of said plug and said earphone; and said magnet and said magnetized piece removably secure said plug and said earphone to one another.

3. The anti-tangling device according to claim 1, further comprising:

a hook-and-loop type fastener having a first and second part;

each of the first and second parts of said hook-and-loop type fastener is secured to a respective one of said plug and said earphone; and said first and second parts of said hook-and-loop type fastener removably secure said plug and said earphone to one another.

4. The anti-tangling device according to claim 1, further comprising:

a press-fit snap fastener having a first and second part;

each of the first and second parts of said snap fastener is secured to a respective one of said plug and said earphone; and said first and second parts of said snap fastener removably secure said plug and said earphone to one another.

5. The anti-tangling device according to claim 1, wherein:

said plug-in portion is at least one snap ring attached to said earphone by a press fit and operable to removably secure said earphone to said male plug.

6. The anti-tangling device according to claim 1, further comprising:

at least one additional earphone at said proximal end; and each of said plug and said earphones having one of first, second, and third parts of a three-part connection device, said three-part connection device removably securing said plug and said earphones to one another.

7. The anti-tangling device according to claim 6, wherein said three-part connection device is a plate with three sockets shaped to connectively secure a respective one of said plug and said two earphones therein and, when secured, forming a continuous loop with said cord, said plug, and said earphones.

8. The anti-tangling device according to claim 7, wherein said three sockets are three female sockets shaped to connectively secure therein a respective one of said plug and said two earphones.

9. The anti-tangling device according to claim 8, wherein said three female sockets are each press-fit sockets shaped to connectively secure therein a respective one of said plug and said two earphones.

10. The anti-tangling device according to claim 6, wherein said three-part connection device is a set of three snap connections each positioned to connectively secure a respective one of said plug and said two earphones.

11. The anti-tangling device according to claim 6, wherein said three-part connection device is a three-armed clip individually securing each of said plug and said earphones to one of said arms.

12. The anti-tangling device according to claim 1, further comprising:

a geometric solid having an outermost edge and defining at least two inlets for said plug and said earphone starting at said outermost edge, each of said inlets forming a press-fit opening operable to removably secure at least one of said signal plug and said earphone therein.

13. The anti-tangling device according to claim 12, wherein said geometric solid is separate from said headphone cord.

14. The anti-tangling device according to claim 12, wherein said inlets have a relatively narrow portion and a relatively larger portion expanding from said narrow portion and continuing inwards towards a middle of said geometric solid.

* * * * *